US009035641B1

(12) United States Patent
Le et al.

(10) Patent No.: US 9,035,641 B1
(45) Date of Patent: May 19, 2015

(54) STARTUP CIRCUIT

(75) Inventors: Thien Le, San Jose, CA (US); Ping-Chen Liu, Fremont, CA (US)

(73) Assignee: Altera Corporation, San Jose, CA (US)

( * ) Notice: Subject to any disclaimer, the term of this patent is extended or adjusted under 35 U.S.C. 154(b) by 211 days.

(21) Appl. No.: 13/154,149

(22) Filed: Jun. 6, 2011

(51) Int. Cl.

| | |
|---|---|
| ***G05F 3/20*** | (2006.01) |
| ***H01F 38/32*** | (2006.01) |
| ***G05F 3/16*** | (2006.01) |
| ***G05F 3/08*** | (2006.01) |
| ***G05F 3/04*** | (2006.01) |

(52) U.S. Cl.
CPC *H01F 38/32* (2013.01); *G05F 3/16* (2013.01); *G05F 3/08* (2013.01); *G05F 3/04* (2013.01)

(58) Field of Classification Search
CPC ..... G05F 3/30
USPC ..... 323/313, 315, 280, 314, 311, 312, 901, 323/265, 268, 273; 327/143, 539
See application file for complete search history.

(56) References Cited

U.S. PATENT DOCUMENTS

| | | | | |
|---|---|---|---|---|
| 6,037,832 | A * | 3/2000 | Kaminishi | 327/538 |
| 6,356,064 | B1 * | 3/2002 | Tonda | 323/313 |
| 2005/0212572 | A1 * | 9/2005 | Adams et al. | 327/143 |
| 2010/0164608 | A1 * | 7/2010 | Shin | 327/539 |
| 2010/0289472 | A1 * | 11/2010 | Renous | 323/282 |

* cited by examiner

*Primary Examiner* — Matthew Nguyen
*Assistant Examiner* — Trinh Dang
(74) *Attorney, Agent, or Firm* — Womble, Carlyle, Sandridge & Rice

(57) ABSTRACT

A startup circuit to ensure a bandgap reference circuit reliably starts up or recovers from a noise disturbance is provided. The startup circuit incorporates a pull down resistor to detect the bandgap reference circuit being in a disabled state. The startup circuit creates a positive feedback loop to force the bandgap reference circuit out of a disabled state. Consequently, whenever the power supply for the bandgap reference circuit sags or if bandgap output collapses, the output of the bandgap circuit reliably ramps back up to the expected level.

20 Claims, 5 Drawing Sheets

STARTUP CIRCUIT

BACKGROUND

A bandgap reference circuit provides a constant voltage over a temperature range and is commonly used to supply a reference voltage that is compared with other voltages within an integrated circuit. A bandgap reference circuit typically combines two potentials, one having a positive temperature coefficient and another having a negative temperature coefficient to provide the reference voltage.

A startup circuit is commonly incorporated with the bandgap reference circuit to ensure the bandgap reference circuit starts. The startup circuit functions to set the proper operational state during power up of the bandgap reference circuit. However, in some instances, the bandgap reference circuit may not "wake up" properly after power up or after an external noise disturbance. For example, under certain process voltage temperature (PVT) conditions, where the power supply sags or where the bandgap reference voltage collapses due to an external noise disturbance, the bandgap reference voltage may not reliably ramp up to the expected reference voltage.

It is within this context that the embodiments arise.

SUMMARY

Embodiments described herein provide a reliable startup circuit for a bandgap circuit. It should be appreciated that the present embodiments can be implemented in numerous ways, such as a process, an apparatus, a system, a device or a method on a computer readable medium. Several embodiments are described below.

In one embodiment, a circuit for providing a reference voltage and reference current is provided. The circuit includes a current to voltage converter in communication with a feedback circuit. The current to voltage converter is operable to prevent a closed loop condition within the feedback circuit. A common source amplifier is coupled to the current to voltage converter. The common source amplifier is operable to amplify a received voltage and transition a logic signal to open gates of transistors within the feedback circuit in order to initiate current flow into diode branches of the feedback circuit.

In another embodiment, a bandgap reference circuit is provided. The bandgap reference circuit includes startup circuitry, current source and operational amplifier circuitry, feedback circuitry, and output reference circuitry. The startup circuitry is operable to initiate power transmission to the current source and operational amplifier circuitry of the bandgap circuit. The current source and operational amplifier circuitry are operable to open current paths in response to initiating power transmission thereby providing an output signal to the feedback circuitry to open gates of transistors of the feedback circuitry to provide current flow through the transistors of the feedback circuitry to diode branches of the feedback circuitry. The current flow establishes a reference voltage output from the output reference circuitry. The startup circuitry includes a current to voltage converter operable to establish that the output signal to the feedback circuitry transitions in order to open the gates of the transistors within the feedback circuitry.

In yet another embodiment a method for reliably providing a reference voltage from a bandgap circuit is provided. The method includes enabling an operational amplifier through a startup circuit of the bandgap circuit, and detecting a closed loop condition for output of the operational amplifier. In response to detecting the closed loop condition, the method includes initiating a positive feedback loop causing the reference voltage to increase as a voltage level at a first node within a startup circuit of the bandgap circuit increases. The method further includes transitioning the positive feedback loop to a negative feedback loop upon detecting stabilization of the reference voltage.

Other aspects of the embodiments will become apparent from the following detailed description, taken in conjunction with the accompanying drawings, illustrating by way of example the principles of the embodiments.

BRIEF DESCRIPTION OF THE DRAWINGS

The embodiments may best be understood by reference to the following description taken in conjunction with the accompanying drawings.

DETAILED DESCRIPTION

The following embodiments describe a bandgap circuit having a reliable startup circuit for an integrated circuit (IC). The present embodiments may be practiced without some or all of these specific details. In other instances, well-known operations have not been described in detail in order not to unnecessarily obscure the present embodiments.

The embodiments described herein provide circuitry to ensure a bandgap circuit reliably starts up or recovers from a noise disturbance. The startup circuit incorporates a current to voltage converter to detect a closed loop condition for the bandgap reference circuit, i.e., where the bandgap reference circuit is in a disabled state. A positive feedback loop is created by the circuit architecture to force the bandgap reference circuit out of the disabled state. Consequently, whenever the power supply for the bandgap reference circuit sags or if bandgap output collapses, the output of the bandgap circuit reliably ramps back up to the expected bandgap output level.

Figure 1:
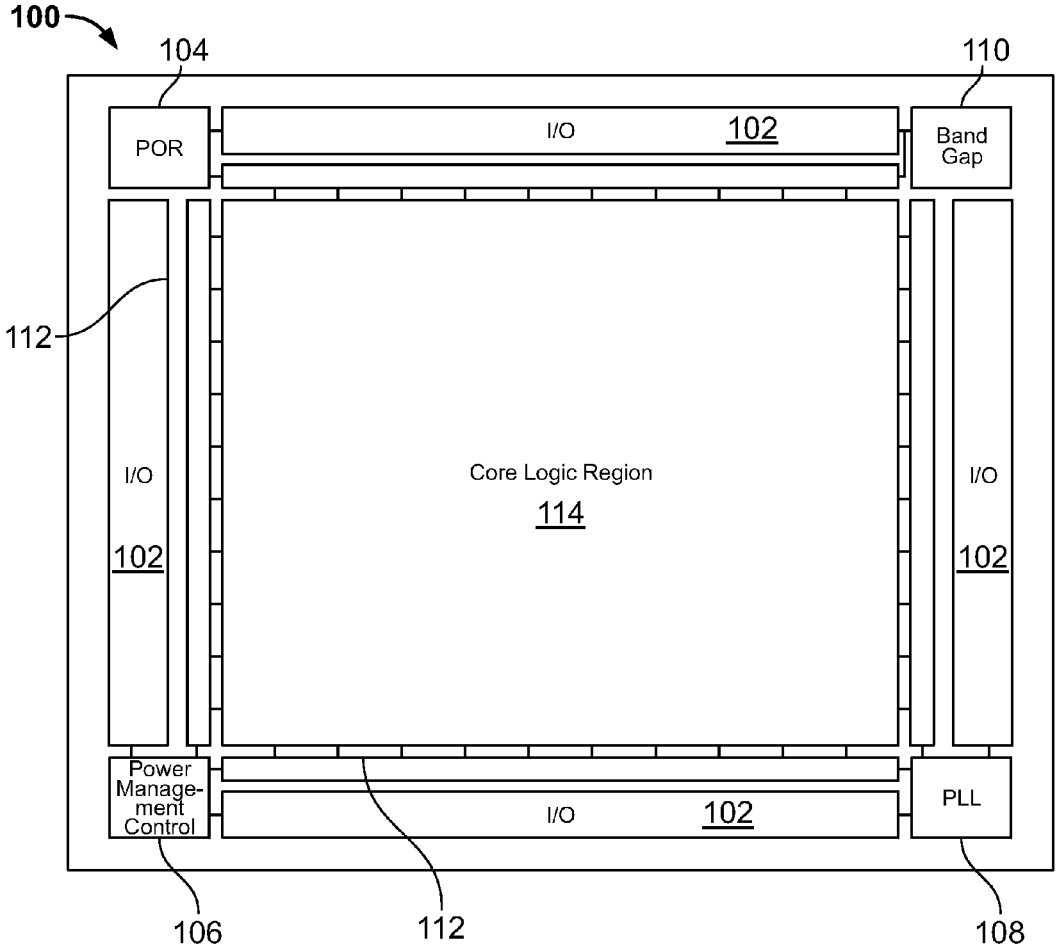
FIG. 1 is a simplified block diagram of an integrated circuit that can include aspects of the present embodiments.

FIG. 1 is a simplified block diagram of an integrated circuit that can include aspects of the present embodiments. Integrated circuit 100 includes core logic region 114 and I/O elements 102. I/O elements 102 may support a variety of memory interfaces and communication protocols. Other auxiliary circuits such as phase-locked loops (PLLs) 108 for clock generation and timing, power on reset (POR) block 104, and power control management block 106, can be located outside core logic region 114, e.g., at corners of integrated circuit 100 and adjacent to I/O elements 102. It should be appreciated that core logic region 114 may be populated with logic cells which include, among other things, at the most basic level, "logic elements" (LEs). LEs may include look-up table-based logic regions and these logic elements may be grouped into "Logic Array Blocks" (LABs). The logic elements and groups of logic elements or LABs can be configured to perform logical functions desired by the user. Bandgap reference circuit 110 provides a reference voltage to core logic region 114 through power ring 112. Power ring 112 includes channel paths into core logic region 114. It should be appreciated that the architecture of FIG. 1 is exemplary and not meant to be limiting as alternative architectures may incorporate the bandgap reference circuit and corresponding startup circuitry described herein.

Figure 2:
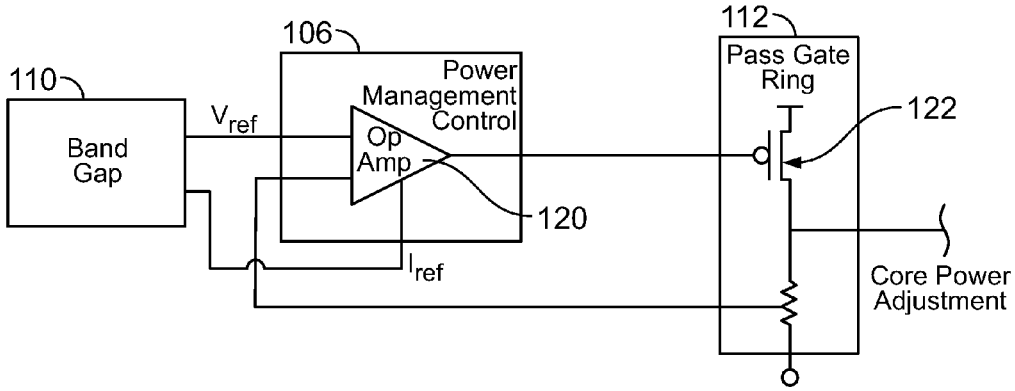
FIG. 2 is a simplified schematic diagram illustrating further details of the circuitry for providing a voltage reference for an integrated circuit in accordance with one embodiment.

FIG. 2 is a simplified schematic diagram illustrating further details on the circuitry for providing a voltage reference for an integrated circuit in accordance with one embodiment. Bandgap reference circuit 110 provides a bandgap output, i.e., a reference voltage (Vref), to operational amplifier 120 of power management control 106. Operational amplifier 120 of power management control block 106 outputs a signal to a gate of pass gate transistor 122 of pass gate ring 112. A signal traverses through pass gate transistor 122 for entry into the core logic region 114, when the pass gate transistor is open. Signal $I_{ref}$ is provided from bandgap reference circuit 110 to operations amplifier 120 of power management control block 106.

Figure 3:
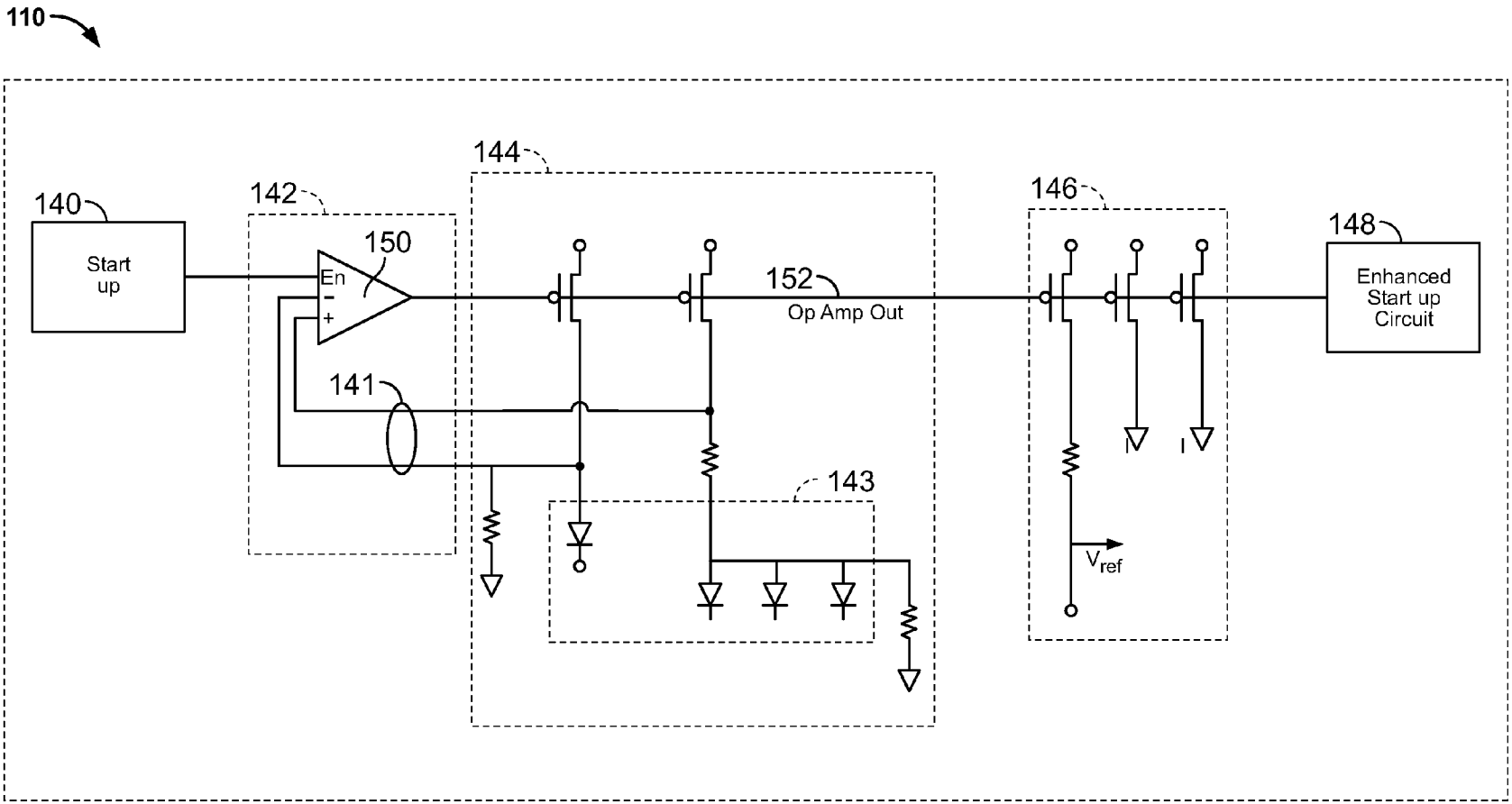
FIG. 3 is a simplified schematic diagram illustrating further details of the bandgap reference circuit in accordance with one embodiment.

FIG. 3 is a simplified schematic diagram illustrating further details of the bandgap reference circuit in accordance with one embodiment. Bandgap reference circuit 110 includes startup circuitry 140, current source and operational amplifier circuitry 142, feedback circuitry 144, output reference circuitry 146, and enhanced startup circuitry 148. Startup circuitry 140 provides a signal to power up or initialize the bandgap reference circuit 110. Current source and operational amplifier circuitry 142 provides output signal 152 to feedback circuitry 144. Feedback circuitry 144 includes diode branches 143 and generates feedback control signals 141 through commonly known bandgap reference techniques. Output reference circuitry 146 provides the voltage reference output, as well as current reference output from the bandgap reference circuit 110. Enhanced startup circuitry 148 provides circuitry configured to reliably start up bandgap reference circuit 110 in the event of a power sag or noise disturbance. However, it should be appreciated that under certain conditions, the output from the operational amplifier 150 can become stuck at a high larger to level. In this instance, the bandgap circuit will not be able to start up without the enhanced startup circuitry 148. In one embodiment, the enhanced startup circuitry 148 provides a positive feedback loop to pull the output 152 from operational amplifier 150 low so that the voltage reference output (Vref) from bandgap reference circuit 110 ramps up to a desired level. Once the voltage reference output is stable, the enhanced startup circuitry 148 turns off, and the feedback circuitry 144 transitions from the positive feedback loop to a negative feedback loop to maintain Vref.

Figure 4:
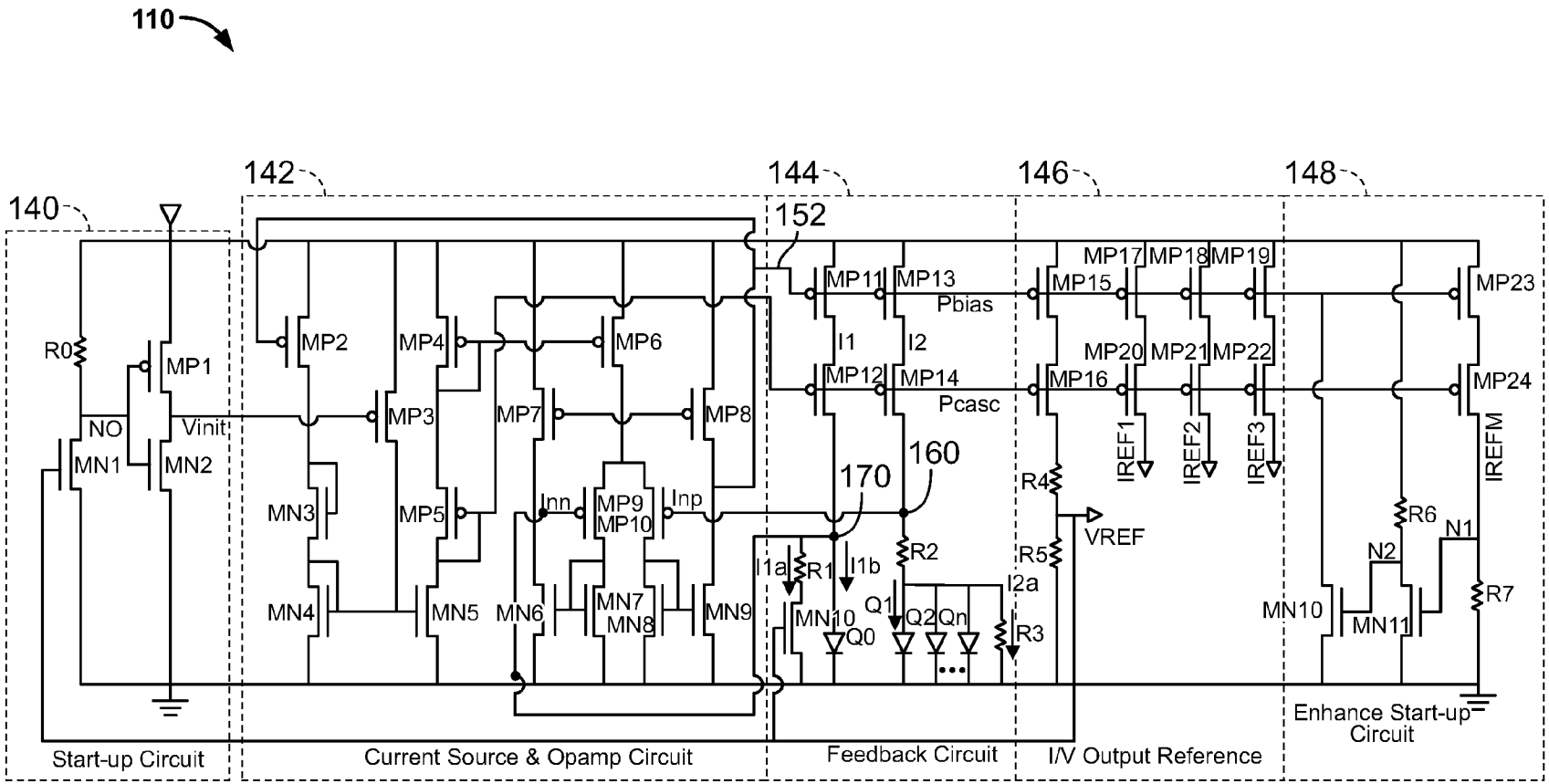
FIG. 4 is a simplified schematic diagram illustrating a detailed transistor level arrangement for each of the circuit blocks of FIG. 3 in accordance with one embodiment.

FIG. 4 is a simplified schematic diagram showing a detailed transistor level arrangement for each of the circuit blocks of FIG. 3 in accordance with one embodiment. The signal pathways through each of the transistors of the circuit blocks are not described in complete detail in order not to obscure the functionality performed by each of startup circuitry 140, current source and operational amplifier circuitry 142, feedback circuitry 144, and output reference circuitry 146. Bandgap reference circuit 110 may be initialized through a signal propagated through weak pull up resistor RO to turn off P-type metal oxide semiconductor (PMOS) transistor MP1 and to turn on N-type metal oxide semiconductor (NMOS) transistor MN2. With MN2 on, signal $V_{init}$ will be pulled to a logical low level allowing PMOS transistor MP3 to initialize the current source portion of circuitry 142. Current paths are then generated through the pathways and current mirrors of current source and operational amplifier circuitry 142. As a result, output 152 of the current source and operational amplifier circuitry 142 turns on the corresponding PMOS transistors MP11-MP24 of feedback circuitry 144 and output reference circuitry 146. Turning on PMOS transistors MP11-MP14 causes current to flow to the diode branches of feedback circuitry 142. Further, upon startup, NMOS transistor MN10 is in an off state. Therefore, the voltage level at operational amplifier input node Inn is higher than the voltage level at operational amplifier input node Inp, as transistor MN10 blocks the path to ground from node 170 while the path to ground from node 160 through resistor R3 is not blocked.

As a result of transistor MN11 turning on, the voltage at node Inn begins to drop and the voltage level at output 152 is further driven low, i.e., a positive feedback loop is formed. The bandgap output (Vref) begins to rise until Vref reaches a final stable level. It should be appreciated that Vref rises to a voltage level high enough to turn on transistor MN10. Once transistor MN10 is turned on the positive feedback loop transitions to a negative feedback loop where the voltage at node Inn is driven higher. Once Vref reaches the final stable level, the voltage level at node Inp is greater than the voltage level at node Inn of feedback circuitry 144. It should be appreciated that the embodiments are not restricted to the exemplary configuration and type of transistors described herein as the PMOS transistors may be replaced with NMOS transistors, and vice versa.

It should be appreciated that in certain operating circumstances, the output 152 of the current source and operational amplifier circuitry 142 may be stuck at a logical high level due to a power sag, a voltage offset at nodes 170 or 160, or due to a noise disturbance. In these circumstances, enhanced startup circuitry 148 of FIG. 4 enables bandgap reference circuit 110 to reliably recover from such a power sag condition, voltage offset, or noise disturbance. After a power sag condition, voltage offset, or noise disturbance, a condition may exist where the voltage at node Inp is greater than the voltage at node Inn and Vref were zero. Without enhanced startup circuitry 148, this condition would cause opamp 142 to drive 152 high which in turn would maintain Vref at zero voltage and MN10 would remain off, perpetuating the misalignment of the Inn 170 and Inp 160 nodes.

Enhanced startup circuitry 148 provides a mechanism to create a positive feedback loop in feedback circuitry 142 by pulling output 152 low when output 152 reaches a high level, which indicates that the output of the bandgap reference circuit (Vref) is too low to activate MN10. Once output 152 is pulled low, the feedback circuit 144 is reinitiated and may regain control of the opamp 142's output 152. In the embodiment depicted in FIG. 4, enhanced start-up circuit 148 operates as follows. R7 operates as a current to voltage converter, sensing current through MP20. If output 152 is high, PMOS transistor MP20 is in an off state. This cuts off current to current to voltage converter R7 and thus R7 outputs a low voltage on node N1. Node N1 serves as input to a common source amplifier, also referred to as a pull up resistor module (NMOS transistor MN11 and resistor R6) which amplifies the voltage on N1 to drive the gate of pull down NMOS transistor MN10'. When N1 is pulled low by R7, it provides a low signal to the gate of NMOS transistor MN11, which turns off MN11. With MN11 in an off state, node N2 is pulled up to a high value by R6 which is connected to the upper voltage supply. When N2 is high, it turns on NMOS transistor NM10' which in turn pulls output 152 low. As soon as output 152 drops sufficiently to turn on MP20, R7 detects the current and increases the voltage at node N1. When node N1 transitions to a high value it turns on MN11, which in turn pulls node N2 low and turns off transistor MN10' allowing output 152 to be controlled by the opamp circuit 142 and feedback circuitry 144 through the positive feedback loop.

Once output 152 is stabilized, the positive feedback loop transitions to a negative feedback loop as the voltage at both Inn and Inp are aligned (Inn rests at a lower voltage than Inp) and output 152 is controlled via the feedback circuit's 144 negative feedback loop. By including enhanced startup circuit 148 into bandgap reference circuit 110, whenever the output 152 is stuck high, e.g., there is a closed loop condition, the enhanced startup circuitry 148 pulls output 152 low, thus transistors MP11/MP12/MP13/MP14 can be turned on and the system will enter a positive feedback state until Vref and output 152 stabilizes. At that point the system will transition to normal operation utilizing the negative feedback scheme. It should be appreciated that in one embodiment the enhanced startup circuitry 148 terminates pulling output 152 low prior to transitioning to a negative feedback loop, i.e., before Vref reaches a final stable state. It should be further appreciated that startup circuit 140 and enhanced startup circuitry 148 may be collectively referred to as startup circuitry for bandgap circuit 110.

Figure 5:
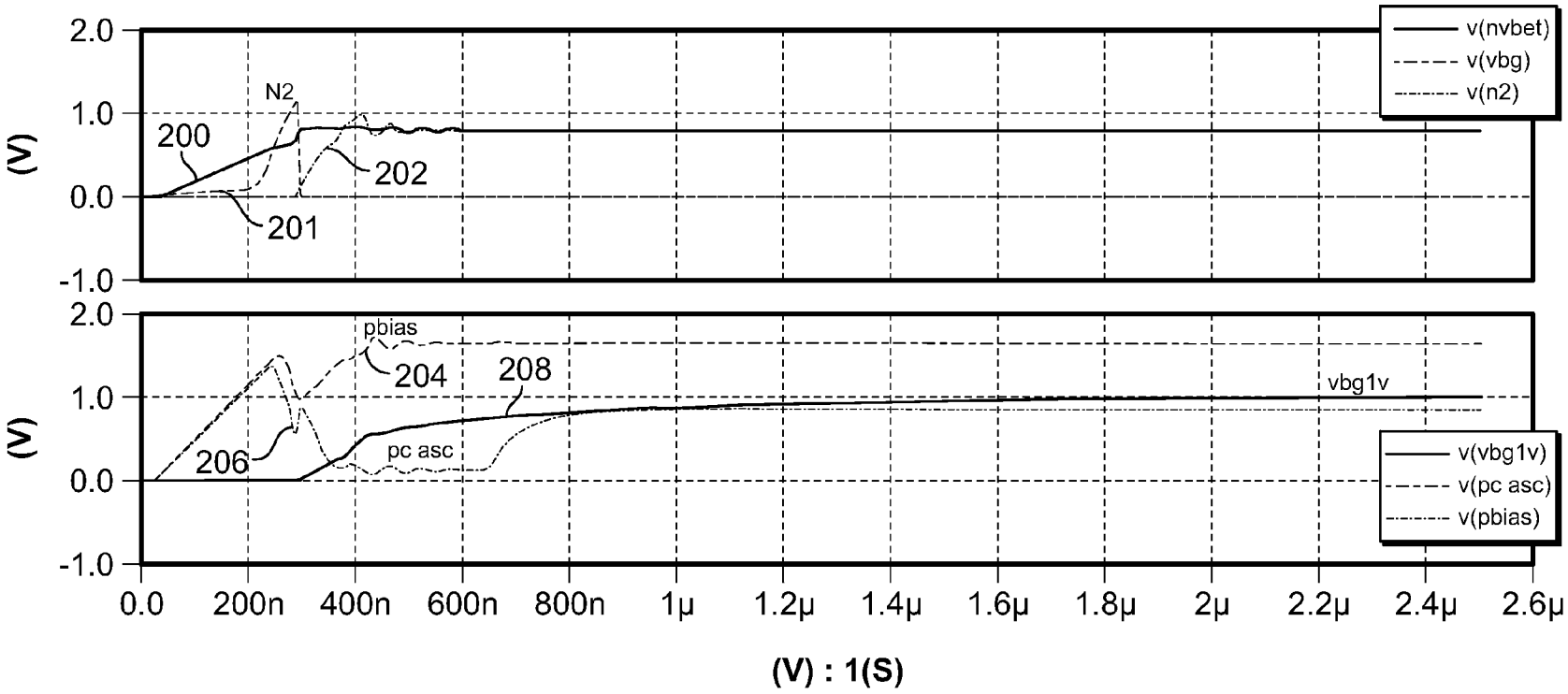
FIG. 5 is a simplified schematic diagram illustrating waveforms of voltage levels for various nodes over time for the bandgap reference circuit having the enhanced startup circuit in accordance with one embodiment.

FIG. 5 is a simplified schematic diagram illustrating waveforms of voltage level for various nodes over time for the bandgap reference circuit having the enhanced startup circuit in accordance with one embodiment. Line 200 represents the voltage level at node Inp, line 201 represents the voltage level at node N2 of the enhanced startup circuit, and line 202 represents the voltage level at node Inn. As discussed above with reference to FIG. 4, the voltage level at node N2 ramps up to turn on transistor MN10' in order to pull down output 152. The voltage at node N2 drops to turn off transistor MN10' thereby initiating a positive feedback loop. Once Vref is high enough to turn on transistor MN10 the positive feedback loop transitions to a negative feedback loop.

As illustrated in FIG. 5, the voltage at node Trip is initially higher than the voltage at node Inn and the voltage at Inn does not collapse, as would be the case without the enhanced startup circuitry under a power sag or noise disturbance condition. Line 204 represents the voltage level of Pbias (output 152), which controls the current source for the system, line 206 represents the voltage level for Pcasc, and line 208 represents the voltage level for Vref, with reference to FIG. 4. As illustrated the voltage level for Pbias drops as the voltage at node N2 rises. In addition, as the voltage at node N2 drops, the voltage at Pbias rises and eventually stabilizes according to the voltage at Pcasc. The voltage level (line 208) for Vref gradually stabilizes over time due to the negative feedback enabled by the enhanced startup circuit.

Figure 6:
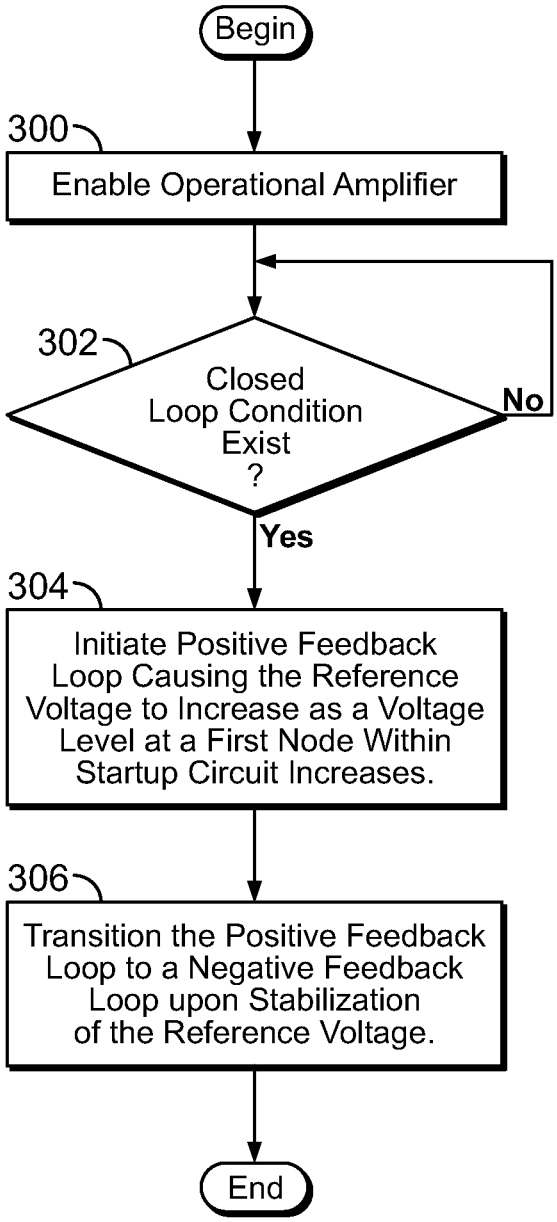
FIG. 6 is a flowchart diagram illustrating the method operations for reliably providing a reference voltage from a bandgap reference circuit in accordance with one embodiment.

FIG. 6 is a flowchart diagram illustrating the method operations for reliably providing a reference voltage from a bandgap reference circuit in accordance with one embodiment. The method initiates with operation 300 where an operational amplifier is enabled through a startup circuit of the bandgap circuit. The method then advances to operation 302 where a check is performed for a closed loop condition for output of the operational amplifier. In one embodiment, the closed loop condition may be caused by a power sag or noise disturbance. As mentioned above, the closed loop condition refers to a state where the output of the operational amplifier is stuck at a high voltage level and the voltage reference output from the bandgap reference circuit is stuck at a low voltage level. If the closed loop condition is not detected then the method continues checking for a closed loop condition.

Once a closed loop condition is detected, the method proceeds to operation 304 where a positive feedback loop causing the reference voltage to increase as a voltage level at a first node within a startup circuit of the bandgap circuit increases is initiated. As discussed above with reference to FIG. 4, the positive feedback loop is defined to continue to pull down the voltage level of the output of the operational amplifier while the voltage level at node Inn begins to rise, thereby further reducing the voltage level at the output of the operational amplifier. The reference voltage also begins to rise based on the reduction of voltage level at the output of the operational amplifier. The method then moves to operation 306 where the positive feedback loop is transitioned to a negative feedback loop in response to detecting stabilization of the reference voltage. As mentioned above with reference to FIG. 4, turning on transistor MN10 initiates the transition to the negative feedback loop. In one embodiment, once the voltage level at node Inp is greater than the voltage level at node Inn, the positive feedback loop transitions to a negative feedback loop. In another embodiment, the transition to a negative feedback loop occurs prior to the stabilization of the reference voltage.

The embodiments, thus far, were described with respect to integrated circuits. The method and apparatus described herein may be incorporated into any suitable circuit. For example, the method and apparatus may be incorporated into numerous types of devices such as microprocessors or programmable logic devices. Exemplary programmable logic devices include programmable array logic (PAL), programmable logic arrays (PLAs), field programmable logic arrays (FPLAs), electrically programmable logic devices (EPLDs), electrically erasable programmable logic devices (EEPLDs), logic cell arrays (LCAs), field programmable gate arrays (FPGAs), application specific standard products (ASSPs), application specific integrated circuits (ASICs), just to name a few.

The programmable logic device described herein may be part of a data processing system that includes one or more of the following components; a processor; memory; I/O circuitry; and peripheral devices. The data processing system can be used in a wide variety of applications, such as computer networking, data networking, instrumentation, video processing, digital signal processing, or any suitable other application where the advantage of using programmable or re-programmable logic is desirable. The programmable logic device can be used to perform a variety of different logic functions. For example, the programmable logic device can be configured as a processor or controller that works in cooperation with a system processor. The programmable logic device may also be used as an arbiter for arbitrating access to a shared resource in the data processing system. In yet another example, the programmable logic device can be configured as an interface between a processor and one of the other components in the system. In one embodiment, the programmable logic device may be one of the family of devices owned by the assignee.

Although the method operations were described in a specific order, it should be understood that other operations may be performed in between described operations, described operations may be adjusted so that they occur at slightly different times or described operations may be distributed in a system which allows the occurrence of the processing operations at various intervals associated with the processing, as long as the processing of the overlay operations are performed in a desired way.

Although the foregoing embodiments have been described in some detail for purposes of clarity of understanding, it will be apparent that certain changes and modifications can be practiced within the scope of the appended claims. Accordingly, the present embodiments are to be considered as illustrative and not restrictive, and the embodiments are not to be limited to the details given herein, but may be modified within the scope and equivalents of the appended claims.

What is claimed is:

1. A startup circuit for a bandgap reference circuit, comprising:

a pull down resistor coupled to a feedback circuit of the bandgap reference circuit, wherein the pull down resistor prevents a closed loop condition within the feedback circuit, the pull down resistor receives a first current mirrored from a reference current output from an output reference circuit of the bandgap reference circuit, the first current passes through the pull down resistor, and the pull down resister outputs a first voltage based on the first current;

a pull up resistor module coupled to the pull down resistor, wherein the pull up resistor module amplifies the first voltage outputted from the pull down resistor and outputs a second voltage; and a pull down transistor coupled to the pull up resistor module, wherein, based on the second voltage, the pull down transistor transitions a logic signal that operates to open a gate of at least one transistor within the feedback circuit thereby initiating current flow through the at least one transistor of the feedback circuit.

2. The startup circuit of claim 1, wherein the startup circuit is coupled to a current source and operational amplifier circuit and the output reference circuit of the bandgap reference circuit, the current source and operational amplifier circuit outputs the logic signal, and the output reference circuit outputs a reference voltage and the reference current.

3. The startup circuit of claim 1, wherein the pull up resistor module includes a resistor and a transistor in series with the resistor.

4. The startup circuit of claim 1, wherein a gate of the pull down transistor controls access through a plurality of transistors within the feedback circuit to ground.

5. The startup circuit of claim 1, wherein a loop defined through the startup circuit and the feedback circuit switches from a positive feedback mode to a negative feedback mode upon stabilization of a reference voltage.

6. The startup circuit of claim 3, wherein a gate of the transistor is coupled to the pull down resistor.

7. The startup circuit of claim 4, wherein the pull down transistor is an NMOS transistor and the plurality of transistors within the feedback circuit are PMOS transistors.

8. A bandgap circuit, comprising:

a startup circuitry;

a current source and operational amplifier circuitry;

a feedback circuitry; and an output reference circuitry, wherein:

the startup circuitry initiates power transmission to the current source and operational amplifier circuitry of the bandgap circuit, the current source and operational amplifier circuitry provides an output signal, the feedback circuitry receives the output signal and provides current flow through a first plurality of transistors of the feedback circuitry to at least one diode branch of the feedback circuitry responsive to the output signal, the output reference circuitry receives the output signal and provides current flow through a second plurality of transistors of the output reference circuitry, the current flow establishing a reference voltage output from the output reference circuitry, and the startup circuitry includes a pull down resistor, a pull up resistor module, and a pull down transistor cooperatively establishing that the output signal received by the feedback circuitry transitions in order to turn on the gates of the first plurality of transistors of the feedback circuitry, wherein:

the pull down resistor is coupled to the feedback circuit and receives a current that mirrors the current flow establishing the reference voltage output from the output reference circuitry, the current passing through the pull down resistor, the pull up resistor module produces a second voltage based on a first voltage of the pull down resistor, the second voltage lowering in response to the first voltage rising, and the pull down transistor is coupled to the pull up resistor module and transitions the output signal received by the feedback circuitry based on the second voltage.

9. The bandgap circuit of claim 8, wherein the feedback circuitry functions in a positive feedback mode while the output signal to the feedback circuitry stabilizes and operates in a negative feedback mode upon stabilization of the output signal, and wherein the startup circuitry transitions the output signal to initiate the positive feedback mode.

10. The bandgap circuit of claim 8, wherein the pull up resistor module includes a resistor and a transistor in series with the resistor.

11. The bandgap circuit of claim 8, wherein a gate of the pull down transistor controls access of the first plurality of transistors within the feedback circuitry to ground.

12. The bandgap circuit of claim 8, wherein the bandgap circuit is integrated into a programmable logic device.

13. The bandgap circuit of claim 8, wherein the pull down resistor is tied to ground.

14. The bandgap circuit of claim 9, wherein the positive feedback mode causes both the feedback circuitry and the startup circuitry to reduce a voltage level of the output signal.

15. A method for reliably providing a reference voltage from a bandgap circuit, comprising;

enabling an operational amplifier through a startup circuit of the bandgap circuit, wherein the startup circuit comprises a pull down resistor, a pull up resistor module coupled to the pull down resistor, and a pull down transistor coupled to the pull up resistor module;

detecting a closed loop condition for an output of the operational amplifier;

initiating, via the pull up resistor module, a positive feedback loop causing the reference voltage to increase as a voltage level at a first node within the startup circuit increases in response to detecting the closed loop condition;

applying the first current through the pull down resistor to increase a voltage level at a second node that serves as input to the pull up resistor module, wherein the first current is mirrored from a reference current from which the reference voltage is derived, and the reference current and the reference voltage are output from an output reference circuit of the bandgap circuit;

decreasing the voltage level at the first node in response to the increase of the voltage level at the second node;

turning off the pull down transistor thereby causing the reference voltage to increase until the reference voltage reaches a stable level; and transitioning the positive feedback loop to a negative feedback loop upon the reference voltage reaching the stable level.

16. The method of claim 15, wherein the startup circuit receives the output of the operational amplifier through the output reference circuit.

17. The method of claim 15, wherein initiating the positive feedback loop comprises:

pulling the output from the operational amplifier from a logical high level state to a logical low level state.

18. The method of claim 15, wherein initiating the positive feedback loop comprises:

amplifying the voltage level at the second node to drive a gate of the pull down transistor.

19. The method of claim 15, wherein transitioning the positive feedback loop comprises:

closing a pathway coupling the output of the operational amplifier to ground upon the reference voltage reaching the stable level.

20. The method of claim 17, wherein the pulling of the output is terminated prior to the transitioning of the positive feedback loop, and the pulling of the output is achieved by coupling the output of the operational amplifier to ground.

* * * * *